US010050344B2

(12) United States Patent
Black et al.

(10) Patent No.: US 10,050,344 B2
(45) **Date of Patent: *Aug. 14, 2018**

(54) BEAM PATTERN SYNTHESIS FOR METAMATERIAL ANTENNAS

(71) Applicant: Elwha LLC, Bellevue, WA (US)

(72) Inventors: Eric J. Black, Bothell, WA (US); Brian Mark Deutsch, Snoqualmie, WA (US); Alexander Remley Katko, Bellevue, WA (US); Melroy Machado, Bellevue, WA (US); Jay Howard McCandless, Alpine, CA (US); Yaroslav A. Urzhumov, Bellevue, WA (US)

(73) Assignee: Elwha LLC, Bellevue, WA (US)

( * ) Notice: Subject to any disclaimer, the term of this patent is extended or adjusted under 35 U.S.C. 154(b) by 96 days.

This patent is subject to a terminal disclaimer.

(21) Appl. No.: 14/954,726

(22) Filed: Nov. 30, 2015

(65) Prior Publication Data

US 2017/0155192 A1 Jun. 1, 2017

(51) Int. Cl.
*H01Q 3/46* (2006.01)

(52) U.S. Cl.
CPC ..... *H01Q 3/46* (2013.01)

(58) Field of Classification Search
CPC ..... H01Q 3/44; H01Q 3/46
See application file for complete search history.

(56) References Cited

U.S. PATENT DOCUMENTS 7,173,565 B2 * 2/2007 Sievenpiper ..... H01Q 15/24 343/700 MS
7,301,508 B1 * 11/2007 O'Loughlin ..... H01Q 3/46 343/912
2004/0008149 A1 * 1/2004 Killen ..... H01Q 3/46 343/795

OTHER PUBLICATIONS

Driscoll et al., Performance of a three dimensional transformation-optical-flattened Luneburg lens, Optics Express, Jun. 4, 2012, vol. 20 No. 12, Optical Society of America.
Larouche et al., Nanotube holograms, Nature, Nov. 1, 2012, pp. 47-48, vol. 491, Macmillan Publishers Limited.
Landy et al., A full-parameter unidirectional metamaterial cloak for microwaves, Nature Materials, Nov. 11, 2012, pp. 1-4, Macmillan Publishers Limited.
Hunt et al., Broadband Wide Angle Lens Implemented with Dielectric Metamaterials, www.mdpi.com/journal/sensors, Aug. 12, 2011, pp. 7982-7991.
Larouche et al., Infrared metamaterial phase holograms, Nature Materials, Mar. 18, 2012, pp. 450-454, vol. 11.
(Continued)

*Primary Examiner* — Daniel J Munoz

(57) ABSTRACT

A determined object wave can be approximately formed by applying a modulation pattern to metamaterial elements receiving RF energy from a feed network. For example, a desired object wave at a surface of an antenna is selected to be propagated into a far-field pattern. A computing system can compute an approximation of the object wave by calculating a modulation pattern to apply to metamaterial elements receiving RF energy from a feed network. The approximation can be due to a grid size of the metamaterial elements. Once the modulation pattern is determined, it can be applied to the metamaterial elements and the RF energy can be provided in the feed network, causing emission of the approximated object wave from the antenna.

23 Claims, 8 Drawing Sheets

(56) References Cited

OTHER PUBLICATIONS

Hunt et al., Planar, flattened Luneburg lens at infrared wavelengths, Optics Express, Jan. 16, 2012, pp. 1706-1713, vol. 20 No. 2, Optical Society of America.
Urzhumov et al., Thin low-loss dielectric coatings for free-space cloaking, Optics Letters, May 15, 2013, pp. 1606-1608, vol. 38 No. 10, Optical Society of America.
Urzhumov et al., Low-loss directional cloaks without superluminal velocity or magnetic response, Optics Letters, Nov. 1, 2012, pp. 4471-4473, vol. 37 No. 21, Optical Society of America.
Ni et al., Metasurface holograms for visible light, Nature Communications, Nov. 15, 2013, pp. 1-6, Macmillan Publishers Limited.
Leon-Saval et al., Mode-selective photonic lanterns for space-division multiplexing, Optics Express, Jan. 13, 2014, pp. 1-9, vol. 22 No. 1, Optical Society of America.
Lalau-Keraly et al., Adjoint shape optimization applied to electromagnetic design, Optics Express, Sep. 9, 2013, pp. 21693-21701, vol. 21 No. 18, Optical Society of America.
Lin et al., Nanostructured Holograms for Broadband Manipulation of Vector Beams, Nano Letters, Aug. 5, 2013, pp. 4269-4274, American Chemical Society.
Jin et al., Advances in Particle Swarm Optimization for Antenna Designs: Real-Number, Binary, Single-Objective and Multiobjective Implementations, IEEE Transactions on Antennas and Propagation, Mar. 2007, pp. 556-567, vol. 55 No. 3, IEEE.
Zhu et al., Design and Optimization of Low Rcs Patch Antennas Based on a Genetic Algorithm, Progress in Electromagnetics Research, 2012, pp. 327-339, vol. 122.
Wu et al., Design Synthesis of Metasurfaces for Broadband Hybrid-Mode Horn Antennas With Enhanced Radiation Pattern and Polarization Characteristics, IEEE Transactions on Antennas and Propagation, Aug. 2012, pp. 3594-3604, vol. 60 No. 8, IEEE.
Boeringer et al., Efficiency-Constrained Particle Swarm Optimization of a Modified Bernstein Polynomial for Conformal Array Excitation Amplitude Synthesis, IEEE Transactions on Antennas and Propagation, Aug. 2005, pp. 2662-2673, vol. 53 No. 8, IEEE.
Yu et al., Flat optics with designer metasurfaces, Nature Materials, Jan. 23, 2014, pp. 139-150, vol. 13, Macmillan Publishers Limited.
Jensen et al., Topology optimization for nano-photonics, Laser Photonics, 2011, pp. 308-321, Rev 5 No. 2, Wiley-Vhe Verleg GmbH & Co.
Orihara et al., Optimization and application of hybrid-level binary zone plates, Applied Optics, Nov. 10, 2001, pp. 5877-5885, vol. 40 No. 32, Optical Society of America.
Seliger et al., Optimization of aperiodic dielectric structures, http://dx.doi.org/10.1063/1.2221497, Aug. 8, 2006, visited Aug. 11, 2014.
Toader et al., Photonic Band Gap Architectures for Holographic Lithography, Physical Review Letters, Jan. 30, 2004, pp. 1-4, vol. 92 No. 4, The American Physical Society.
Sharp et al., Photonic crystals for the visible spectrum by holographic lithography, Optical and Quantum Electronics 34, 2002, pp. 3-12, Kluwer Academic Publishers.
Fong et al., Scalar and Tensor Holographic Artificial Impedance Surfaces, IEEE Transactions on Antennas and Propagation, Oct. 2010, pp. 3212-3221, vol. 58 No. 10, IEEE.
Kildishev et al., Planar Photonics with Metasurfaces, Science 339, http://www.sciencemag.org/content/339/6125/1232009.full.html, Mar. 15, 2013, visited Oct. 8, 2014.
Saravanamuttu et al., Sol-Gel Organic-Inorganic Composites for 3-D Holographic Lithography of Photonic Crystals with Submicron Periodicity, American Chemical Society, Apr. 29, 2003, 4 pgs.
Bayraktar et al., The Design of Miniature Three-Element Stochastic Yagi-Uda Arrays Using Particle Swarm Optimization, IEEE Antennas and Wireless Propagation Letters, Nov. 22, 2005, pp. 22-26, IEEE.
Miller, Photonic Design: From Fundamental Solar Cell Physics to Computational Inverse Design, Thesis, Spring 2012, pp. 137.
Huang et al., Three-dimensional optical holography using a plasmonic metasurface, Nature Communications, Nov. 15, 2013, pp. 1-8, Macmillan Publishers Limited.
Yu et al., Topology optimization for highly-efficient light-trapping structure in solar cells, Research paper, May 10, 2014, pp. 367-382, Springer-Verlag Berlin Heidelberg 2014.
Balanis, C. A., "Antenna Theory: Analysis and Design", Hoboken, NJ: John Wiley, 2005.
Saleh, B. E. A., and Teich, M. C., "Fundamentals of Photonics", Wiley series in pure and applied optics, Hoboken, NJ: Wiley-Interscience, 2007.
Ebadi S., Driscoll T. and Smith D., "Visual Illustration of Microwave Holographic Beamforming using a Modulated Surface-Impedance Metamaterial", Proc. Antennas & Propagation Society International Symposium (APSURSI 2013), pp. 2343-2344, IEEE, 2013. DOI 10.1109/APS.2013.6711830.

* cited by examiner

BEAM PATTERN SYNTHESIS FOR METAMATERIAL ANTENNAS

If an Application Data Sheet (ADS) has been filed on the filing date of this application, it is incorporated by reference herein. Any applications claimed on the ADS for priority under 35 U.S.C. §§ 119, 120, 121, or 365(c), and any and all parent, grandparent, great-grandparent, etc. applications of such applications, are also incorporated by reference, including any priority claims made in those applications and any material incorporated by reference, to the extent such subject matter is not inconsistent herewith.

CROSS-REFERENCE TO RELATED APPLICATIONS

The present application claims the benefit of the earliest available effective filing date(s) from the following listed application(s) (the "Priority Applications"), if any, listed below (e.g., claims earliest available priority dates for other than provisional patent applications or claims benefits under 35 USC § 119(e) for provisional patent applications, for any and all parent, grandparent, great-grandparent, etc. applications of the Priority Application(s)).

Priority Applications:

None

If the listings of applications provided above are inconsistent with the listings provided via an ADS, it is the intent of the Applicant to claim priority to each application that appears in the Domestic Benefit/National Stage Information section of the ADS and to each application that appears in the Priority Applications section of this application.

All subject matter of the Priority Applications and of any and all applications related to the Priority Applications by priority claims (directly or indirectly), including any priority claims made and subject matter incorporated by reference therein as of the filing date of the instant application, is incorporated herein by reference to the extent such subject matter is not inconsistent herewith.

BACKGROUND

The principal function of any antenna is to couple an electromagnetic wave guided within the antenna's structure to an electromagnetic wave propagating in free space. Many approaches exist to implement this coupling and have been studied due to the vast practical applications of antennas.

SUMMARY

A determined object wave at the radiating aperture surface of an antenna can be approximately formed by applying a modulation pattern to metamaterial elements receiving RF energy from a feed network. The object wave at the radiating surface of an antenna is selected so that when propagated into a far-field, the resulting radiation pattern is of a desired shape. A computing system can compute an approximation of the object wave by calculating a modulation pattern to apply to metamaterial elements receiving RF energy from a feed network. The approximation can be due to a grid size of the metamaterial elements (discrete sampling of a continuous quantity). Once the modulation pattern is determined, it can be applied to the metamaterial elements and the RF energy can be provided in the feed network, causing emission of the approximated object wave from the antenna.

In construction of a modulation pattern, the process can be further divided into five operations. In a first operation, the fields in a field network are calculated. The field network includes a reference wave, desired far field pattern and determined object wave. In a second operation, an ideal hologram modulation pattern is calculated from the object and reference wave components of the field network. In a third operation, phase information in the ideal hologram modulation pattern is discarded. In a fourth operation, an aperture taper function is summed with the real portion of the ideal hologram. In a fifth operation, the sum pattern is normalized to form an aperture modulation pattern.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

Figure 1:
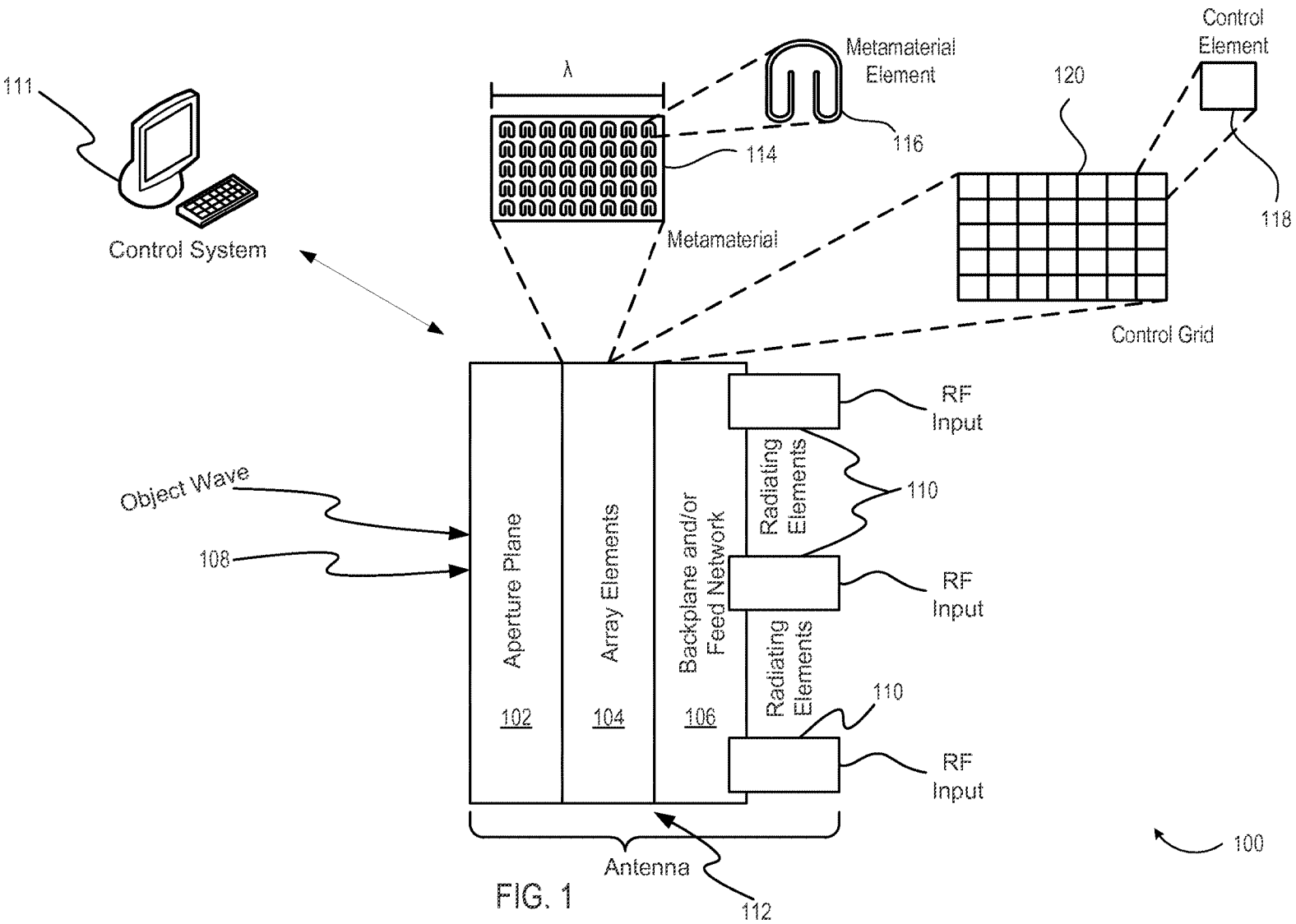
FIG. 1 is a system diagram of a beam pattern synthesis system.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here.

Techniques, apparatus and methods are disclosed that enable a determined object wave to be approximately formed by applying a modulation pattern to metamaterial elements receiving RF energy from a feed network (the reference wave). For example, a desired object wave at a surface of an antenna is desired to be produced by an antenna. A computing system can calculate a modulation pattern to apply to metamaterial elements receiving RF energy to a feed network that will result in an approximation of desired object wave.

In an additional example, determinations can include the antenna system. In one example, the fields in a field network are calculated. An ideal hologram modulation pattern is calculated. Phase information of the hologram modulation pattern is discarded. An aperture taper function is scaled and multiplied with the magnitude portion of the ideal hologram. The sum pattern is normalized to form an aperture modulation pattern. The modulation pattern is formed by a product of the aperture modulation pattern and the desired object wave.

In antennas based on Metamaterial Surface Antenna Technology (MSA-T), coupling between the guided wave and propagating wave is achieved by modulating the impedance of a surface in electromagnetic contact with the guided wave. This controlled surface impedance is called the "modulation pattern." The guided wave in the antenna is referred to as the "reference wave" or "reference mode," and the desired free space propagating wave pattern is referred to as the "radiated wave" or "radiative mode." An "object wave" is simply the far field radiated wave back-propagated to the aperture where both the modulation pattern and reference wave are present.

The general method for selecting the modulation pattern in MSA-T is derived from holographic principles where the surface modulation function ($\psi_{holo}$) is simply the beat of the reference wave ($E_{ref}$) and the object wave ($E_{obj}$). This relationship can be expressed compactly as:

$$\psi_{holo} = \frac{E_{ref}^{*} E_{obj}}{|E_{ref}|^2} \quad \text{Equation 1}$$

This equation suggests that the optimal modulation function only depends on the accuracy to which the radiative wave and reference wave are known. In Equation 1, if both $E_{ref}$ and $E_{obj}$ are normalized, the function $\psi_{holo}$ can take on any value in the complex plane in a circle with a magnitude less than one. It is assumed that the reference wave is well conditioned to not possess any zeros in the region of interest. This is frequently true as the reference wave is usually a phasor quantity with non-zero magnitude.

In some embodiments, the modulating elements used in MSA-Ts can be incapable of completely covering this complex unit circle. However, the modulation function can be adjusted to reflect the achievable modulation values the antenna elements can provide. In addition, the surface can be discretely sampled at fixed locations, leading any choice of modulation pattern to be a sampled approximation of the ideal modulation pattern (also known as an idealized modulation pattern).

Frequently, it is desirable to shape a radiated far-field pattern to manipulate beam width, steer multiple beams, form beam "nulls" or produce exotic beam shapes such as cosecant squared patterns. It can be challenging to synthesize these patterns in a finite aperture.

Phased array antennas have used a number of methods to shape the radiated far-field. However, in phased arrays, the modulating element is capable of arbitrary phase and amplitude modulation. The reference wave is also rendered trivial ($E_{ref}$=1) by use of a corporate feed network. Thus the techniques used to synthesize beams for phased arrays are not directly translatable to MSA-T without some modification.

A method can be applied to controlling beam shaping in MSA-Ts where the input is the desired far-field pattern and the output is the modulation function applied to the discrete MSA-T array elements. In an embodiment, the reference wave in a method is assumed to be a guided wave propagating through a parallel-plate waveguide, a rectangular waveguide or a microstrip line, i.e., an excitation of the form $E_0 e^{-i\beta x}$. In the embodiment, the method can be broken down into two parts, construction of an object wave and construction of a modulation pattern.

In construction of an object wave, the process can be further divided into four operations. In a first operation, a beam profile projection can be defined in the far-field. In a second operation, the far-field pattern can be converted into the spatial-frequency domain. In a third operation, the far-field pattern is back-propagated to an antenna plane. In a fourth operation, the pattern at the antenna is converted to the spatial domain.

In a first operation, a computing resource, such as a controller, defines a desired beam profile projected onto a two-dimensional plane located in the far-field from the antenna. A grid can be defined to have sufficient sampling density to capture propagating spatial frequencies. The grid can also be defined to have sufficient padding around the pattern to minimize aliasing. In some embodiments, when a discrete Fourier transform (rather than continuous) is used, the grid can be defined such that the coordinates of the sample points in the far-field plane will also correspond to element locations at the aperture plane. However, while convenient, the definition of sample points in such a way is not required.

In a second operation, a computing resource uses a Fourier transform to convert the spatial domain far-field pattern into the spatial-frequency domain (sometimes referred to in literature as k-space).

In a third operation, a computing resource constructs a transfer function of free space and uses the transfer function to back-propagate the k-space field description in the far-field back to the antenna plane. The form of the transfer function of free space can vary depending on the choice of coordinate system used. In some embodiments, the k-space can be convenient to use because the action of the free space transfer function on the k-space fields is multiplication and Fourier transforms in the discrete domain computationally efficient.

In some embodiments, an impulse response and convolution can be used, which avoids the use of Fourier transforms. However, depending on the situation, convolution can be computationally taxing.

In a fourth operation, a computing resource can use an inverse Fourier transform to convert the k-space pattern into the spatial domain. The resulting spatial-domain pattern represents the fields needed at the aperture plane to produce the desired far-field pattern. This field is sometimes called the "object wave." After the fourth operation, the computing resource can then move to construction of a modulation pattern at the antenna using the determined object wave.

In construction of a modulation pattern, the process can be further divided into five operations. In a first operation, the fields in a field network are calculated. In a second operation, an ideal hologram modulation pattern is calculated. In a third operation, an aperture taper function is multiplied with the magnitude portion of the ideal hologram. In a fourth operation, phase information is discarded. In a fifth operation, the pattern is shifted and scaled to form the aperture modulation pattern.

In the first operation, a computing resource calculates the fields in the feed network at each radiating element while stimulating the feed input port. These fields are sometimes referred to as a "reference wave." The reference wave structure is antenna dependent and can take on many forms. For MSA-Ts, it frequently has the form of a travelling wave moving along the surface of the antenna.

In the second operation, a computing resource forms an ideal hologram modulation pattern (also known as an ideal modulation pattern) by multiplying a reference wave with an object wave.

In the third operation, the computing resource can form a tapered modulation function by multiplying an aperture taper function with the ideal hologram.

In the fourth operation, the computing resource can take the magnitude of the ideal hologram, discarding phase information between the array elements.

In the fifth operation, the computing resource can normalize the tapered modulation pattern by shifting and scaling the tapered modulation pattern to lie within the upper and lower bounds of the element modulation range to form the aperture modulation pattern.

After the fifth operation, RF inputs can be activated to provide RF energy into the backplane or feed network. The modulation pattern can be applied to a control grid that causes the metamaterial elements to form the object wave that is then propagated into free space.

In some embodiments, a metamaterial can be used as a layer in a beam-forming system. An array of sub-wavelength elements may be configured to transmit an electromagnetic emission according to a specific pattern, direction, beam-formed shape, location, phase, amplitude and/or other transmission characteristic.

For example, according to various embodiments for electromagnetic transmission according to a transmission pattern, each sub-wavelength element may be configured with an electromagnetic resonance at one of a plurality of electromagnetic frequencies. Each sub-wavelength element may also be configured to generate an electromagnetic emission in response to the electromagnetic resonance.

The sub-wavelength elements may be described as "sub-wavelength" because a wavelength of the electromagnetic emission of each respective sub-wavelength element may be larger than a physical diameter of the respective sub-wavelength element. For example, the physical diameter of one or more of the sub-wavelength elements may be less than one-half the wavelength of the electromagnetic transmission within a given transmission medium, such as a quarter wavelength or one-eighth wavelength.

A beam-forming controller may be configured to cause radio frequency energy to be transmitted by one or more radio frequency energy sources at select frequencies. The select frequencies resonate with a select subset of the sub-wavelength elements. This causes the resonating sub-wavelength elements to generate electromagnetic emissions according to a selectable electromagnetic transmission pattern. The radio frequency energy may be conveyed to the various sub-wavelength elements via a common port, such as a waveguide or free space.

In some embodiments, sub-wavelength elements can be created with different frequency sensitivities. For example, sub-wavelength elements can be created with a sensitivity to a distribution of frequencies (such as an intentional distribution created with scaling the size of the elements). Each of the sub-wavelength elements in the pattern is activated by a different frequency. In one example, a first pattern of energy results when a feed of 76.9 gigahertz energy is coupled to the sub-wavelength elements. At 77.1 gigahertz, a second pattern of energy is emitted by the sub-wavelength elements. At 77.3 gigahertz, a third pattern is emitted by the sub-wavelength elements.

In some embodiments, a control layer can be used in conjunction with a metamaterial layer in the form of a grid of control elements. In one embodiment, the control layer is a liquid crystal grid (LCG, sometimes referred to as a matrix) in which a liquid crystal element can alter behavior of a transmission layer element (such as a metamaterial element). In another embodiment, the transmission layer can selectively vary a transmission coefficient of each element of the grid.

In one embodiment, electromagnetic energy from the backplane structure or feed network is coupled to an array of antenna elements, which, if uniformly excited, would generate a particular electromagnetic beam pattern. By coupling a pattern of electromagnetic energy from the backplane structure modulated by the electromagnetic energy, multiplied by the pattern caused by the control elements, a far-field beam pattern is produced by the antenna array. The far-field beam pattern is a convolution of the pattern that the antenna elements generate (as modified by the control elements) with the pattern that the electromagnetic energy generates if radiated by a uniform array of antenna elements.

It should be recognized that while patterns of amplitudes of radio frequency energy are discussed for clarity, patterns of phases of radio frequency energy and/or patterns of amplitudes of radio frequency energy, phases of radio frequency energy, or spatial distributions of intensities can also be used in embodiments. In addition, while embodiments discussed below focus on radio frequency energy for clarity, it should be recognized that other wave types can also be used, including pressure waves, including those found in gases and fluids.

FIG. 1 shows an embodiment of a beam-forming system 100 that includes an antenna 112 and a control system 111. The antenna 112 includes layers that include an aperture plane 102, array elements 104 and a backplane 106 (which includes a feed network). The layers work together to form an object wave 108 from the antenna 112 that can propagate into free space.

The backplane 106 (also known as a backplane cavity or backplane structure) can receive RF energy from radiating elements 110 that receive the RF energy from RF inputs. The backplane 106 can then couple the RF energy into the array elements layer. The array elements layer can include a metamaterial layer 114 and a control grid 120. The control grid 120 can include individual control elements 118 that correspond to metamaterial elements 116. The control grid elements 118 can be used to enable transmission of RF energy by a corresponding metamaterial element 116 or disable transmission of RF energy by a corresponding metamaterial element 116. In some embodiments, the control grid 120 is a liquid crystal grid that selectively enables or disables control elements 118. In some embodiments, each sub-wavelength metamaterial element 116 may also be configured to generate an electromagnetic emission in response to the electromagnetic resonance of RF energy coupled to the sub-wavelength metamaterial element 116 from the backplane 106.

By using the control grid 120 to apply a modulation pattern to the metamaterial layer 114, the object wave 108 can be created at the aperture plane 102 of the antenna 112.

The control system 111 can create the desired object wave 108, such as one that has a desired far-field beam pattern, by calculating and applying a modulation pattern to the metamaterial layer 114.

For example, construction of a modulation pattern can be determined and then applied to an antenna system. The control system 111 calculates the fields in the feed network of the backplane 106 at each radiating element while stimulating the feed input port. The control system 111 determines an ideal hologram modulation pattern by multiplying a reference wave with the desired object wave 108. The control system 111 discards a phase part and takes a magnitude part of the determined ideal hologram. The control system 111 fits an aperture taper function which is multiplied to the magnitude of the ideal hologram. The pattern is shifted and scaled such that all elements have values greater than or equal to a lower bound of the element modulation range (or depth) and less than the upper bound of the element modulation range (or depth) to form the aperture modulation pattern. The control system 111 applies the modulation pattern to the aperture plane 102. The reference wave interacts with the modulation pattern to form the object wave 108 at the aperture plane 102.

After determining the modulation pattern, the control system 111 can create the desired object wave 108. RF inputs can be activated to provide RF energy into the backplane 106 or feed network, such as through radiating elements 110. The modulation pattern can be applied to the control grid 120 that causes the metamaterial elements 116 to form the object wave 108 that is then propagated into free space.

In an alternate embodiment, the control system 111 discards an imaginary part and takes a real part of the determined ideal hologram. The control system 111 fits an aperture taper function which has been scaled so that when it is added to the real part of the ideal hologram elements of the sum have values greater than or equal to a lower bound of the element modulation range (or depth). The control system 111 normalizes the sum pattern by the upper bound of the element modulation range (or depth) to form the aperture modulation pattern. The control system 111 applies the modulation pattern to the aperture plane 102 by taking the product of the modulation pattern and reference wave to form the radiated field at the aperture plane 102.

Figure 2:
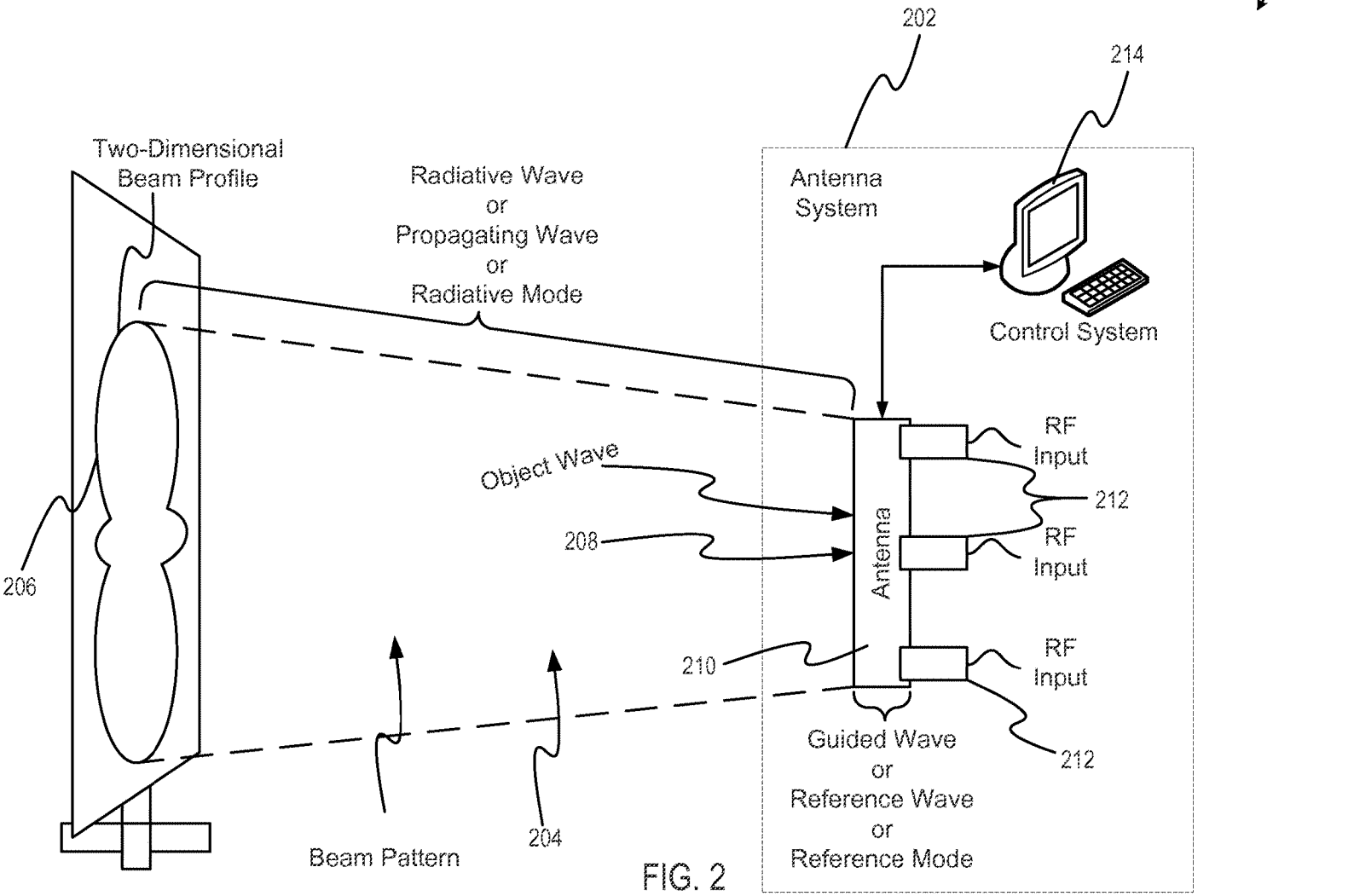
FIG. 2 is a diagram of beam forming using a beam pattern synthesis system.

FIG. 2 shows a beam forming using a beam pattern synthesis system 200. The beam pattern synthesis system 200 can include an antenna 210 (such as the antenna 112 of FIG. 1). A user or system can determine a two-dimensional beam profile 206 that is desired in a far-field of the antenna 210. The two-dimensional beam profile 206 can be back-propagated to a representation of an object wave 208 at an aperture of the antenna 210. As described above in relation to FIG. 1, a control system 214 of an antenna system 202 can determine how to create the object wave 208 from the antenna 210 that results in the two-dimensional beam profile 206.

Once the antenna system 202 determines how to approximate the object wave 208, the antenna system 202 can provide an RF input 212 into the antenna 210 to create a guided wave (also known as a reference wave or reference mode). The antenna 210 can then use the guided wave to produce the object wave 208 at an aperture of the antenna 210. The object wave 208 then radiates from the antenna 210 to form a radiated wave (also known as a propagating wave or radiative wave). The radiated wave forms a beam pattern 204 as it radiates. The beam pattern 204 then approximates the desired two-dimensional beam profile 206.

Figure 3:
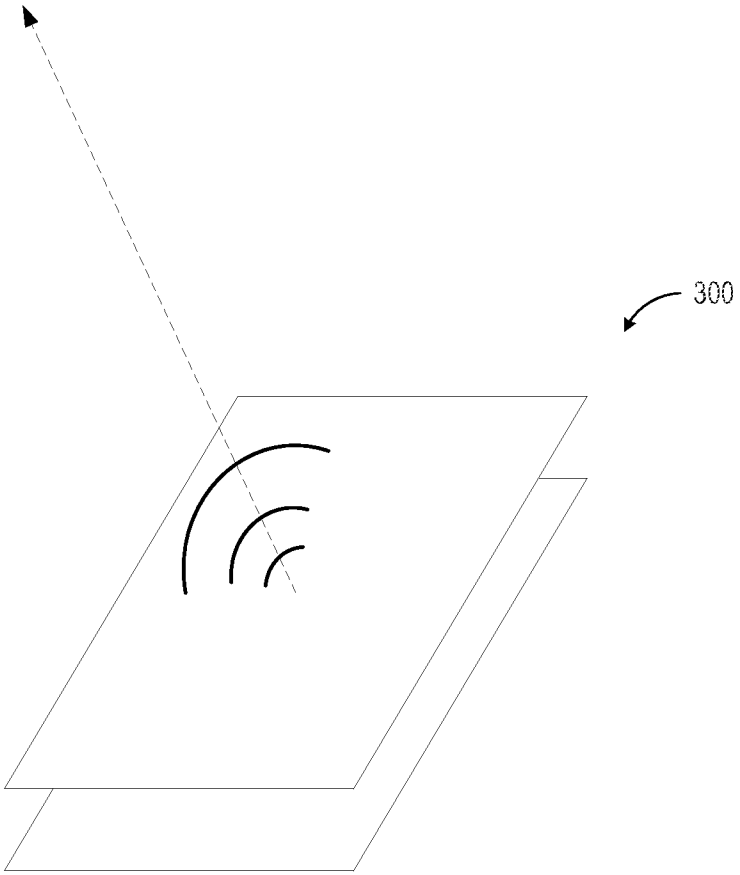
FIG. 3 is a diagram of a parallel-plate waveguide that can be used in conjunction with a beam pattern synthesis system.
Figure 4:
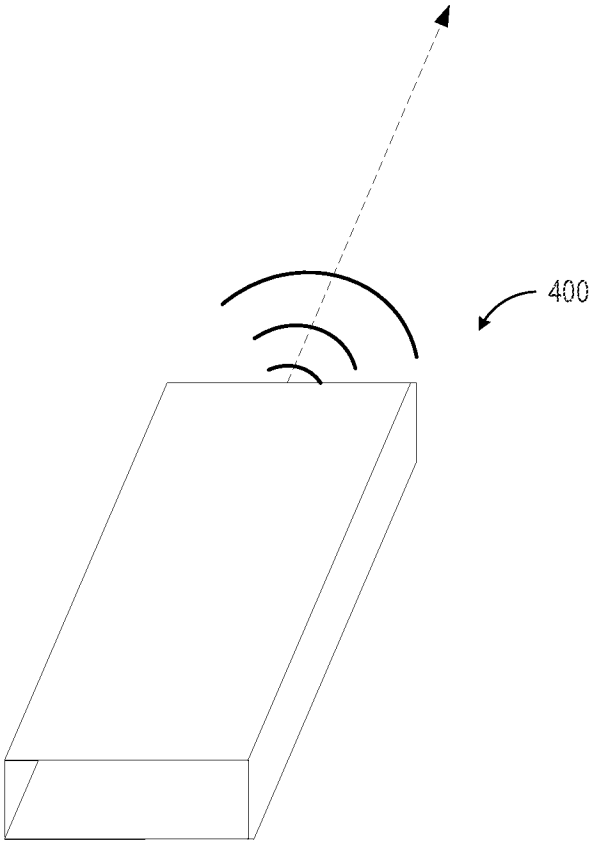
FIG. 4 is a diagram of a rectangular waveguide that can be used in conjunction with a beam pattern synthesis system.
Figure 5:
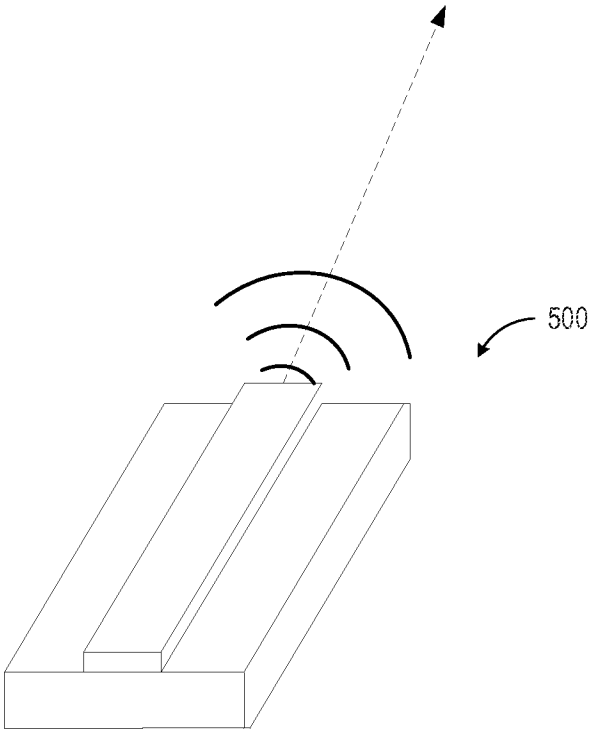
FIG. 5 is a diagram of a microstrip line that can be used in conjunction with a beam pattern synthesis system.

FIGS. 3-5 show a set of waveguides that can be used as part of the antenna (210 in FIGS. 2 and 112 in FIG. 1). FIGS. 3-5 are meant to show examples of waveguides and/or antenna structures, but not limit the types of waveguides and/or antenna structures that can be used. For example, a transmission line structure and/or substrate integrated waveguide can also be used.

FIG. 3 is a diagram of a parallel-plate waveguide 300 that can be used in conjunction with a beam pattern synthesis system. The parallel-plate waveguide 300 can provide varying angles of emission that deviate from the plate normally when used with metamaterial technology.

FIG. 4 is a diagram of a rectangular waveguide 400 that can be used in conjunction with a beam pattern synthesis system. The rectangular waveguide 400 can provide varying angles of emission that deviate from the waveguide axis when used with metamaterial technology.

FIG. 5 is a diagram of a microstrip line 500 that can be used in conjunction with a beam pattern synthesis system. The microstrip line 500 can provide varying angles of emission when used with metamaterial technology.

Figure 6:
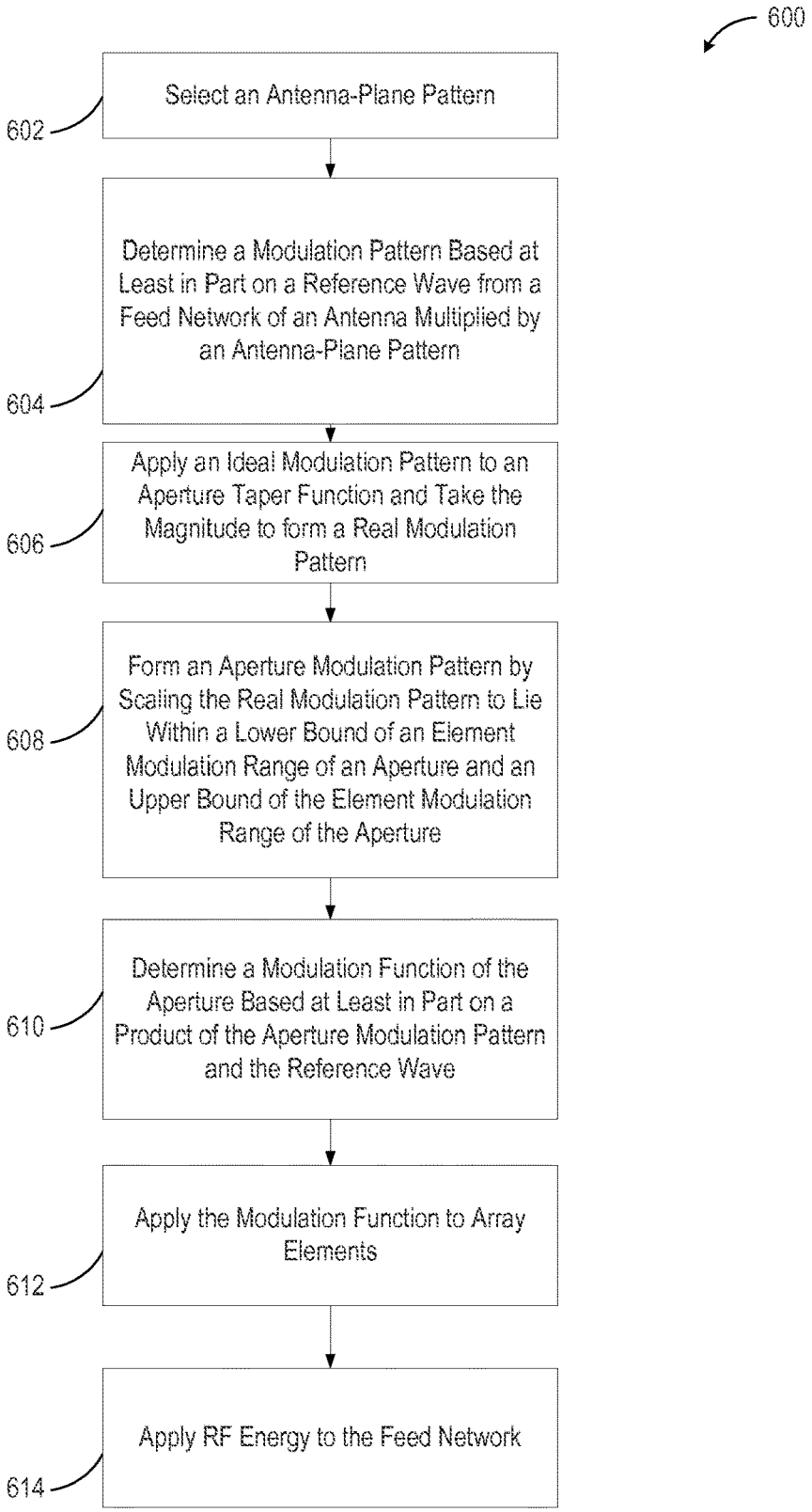
FIG. 6 is a block diagram of a method of beam pattern synthesis.

FIG. 6 is a block diagram of a method 600 of beam pattern synthesis. The method 600 can be implemented by a system 100 such as shown in FIG. 1 including control system 111, antenna 112, aperture plane 102, array elements 104, backplane 106 and feed network. In block 602, a control system receives a selected antenna-plane pattern (such as a desired object wave). In block 604, the control system determines a modulation pattern based at least in part on a reference wave from a feed network of an antenna multiplied by the antenna-plane pattern. In block 606, the control system applies an ideal modulation pattern to an aperture taper function and takes the magnitude to form a real modulation pattern. In block 608, the control system forms an aperture modulation pattern by scaling the real modulation pattern to lie within a lower bound of an element modulation range of an aperture and an upper bound of the element modulation range of the aperture. In block 610, the control system determines a modulation function of the aperture based at least in part on a product of the aperture modulation pattern and the reference wave. In block 612, the control system applies the modulation function to array elements of the antenna. In block 614, the control system applies RF energy to the feed network.

Figure 7:
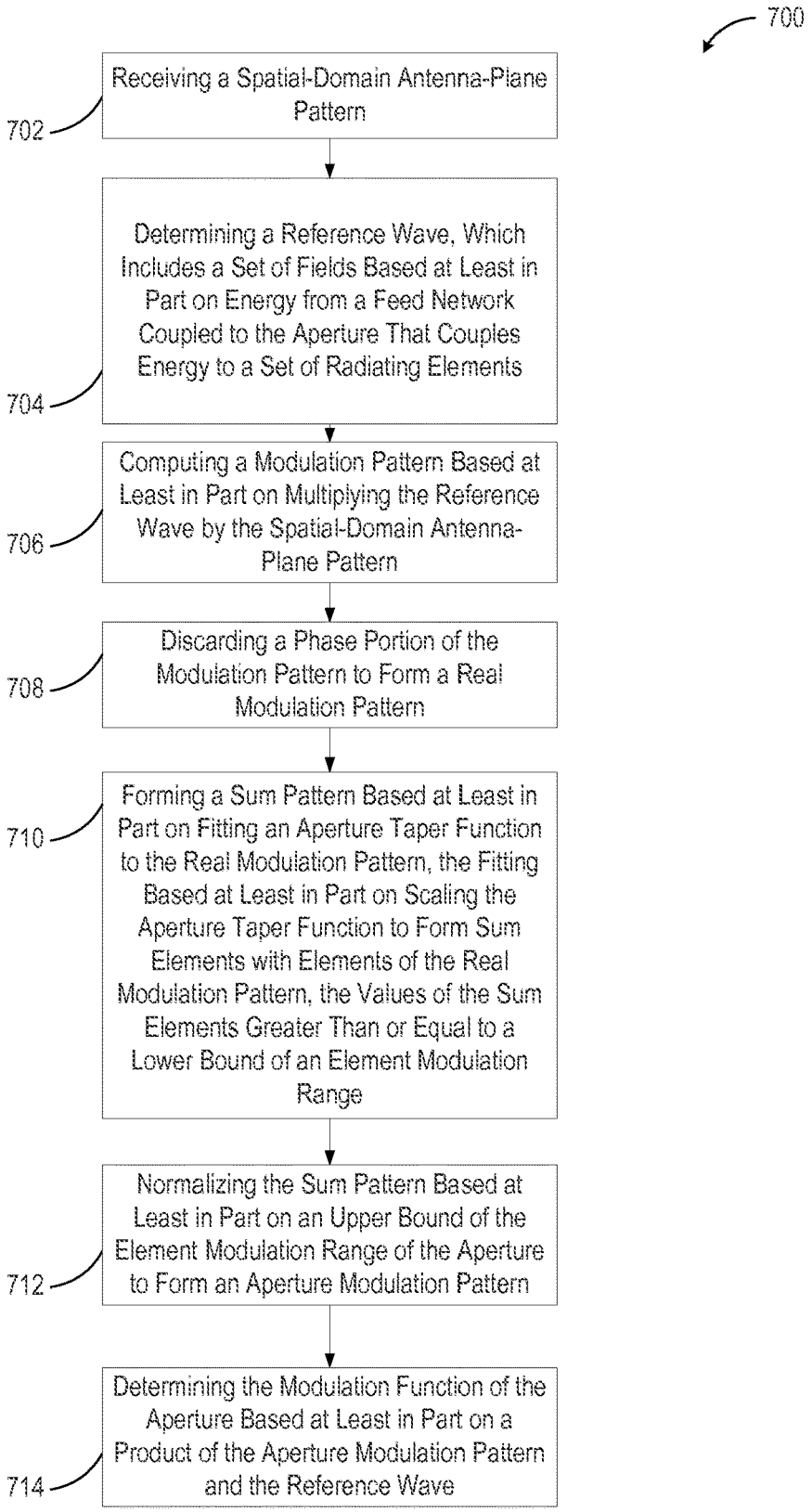
FIG. 7 is a block diagram of an alternative method of beam pattern synthesis.

FIG. 7 is a block diagram of an alternative method 700 of beam pattern synthesis. The method 700 can be implemented by a system 100 such as shown in FIG. 1, including control system 111, antenna 112, aperture plane 102, array elements 104, backplane 106 and feed network. In block 702, a control system receives a spatial-domain antenna-plane pattern (such as a desired object wave). In block 704, the control system determines a reference wave, which includes a set of fields based at least in part on energy from a feed network coupled to the aperture that couples energy to a set of radiating elements. Each field corresponds to a radiating element in an antenna plane. In block 706, the control system computes a modulation pattern based at least in part on multiplying the reference wave by the spatial-domain antenna-plane pattern. In block 708, the control system discards a phase portion of the modulation pattern and takes a magnitude of the modulation pattern to form a real modulation pattern. In block 710, the control system forms a sum pattern based at least in part on fitting an aperture taper function to the real modulation pattern, the fitting based at least in part on scaling the aperture taper function to form sum elements with elements of the real modulation pattern, the values of the sum elements greater than or equal to a lower bound of an element modulation range. In block 712, the control system normalizes the sum pattern based at least in part on an upper bound of the element modulation range of the aperture to form an aperture modulation pattern. In block 714, the control system determines the modulation function of the aperture based at least in part on a product of the aperture modulation pattern and the reference wave.

Figure 8:
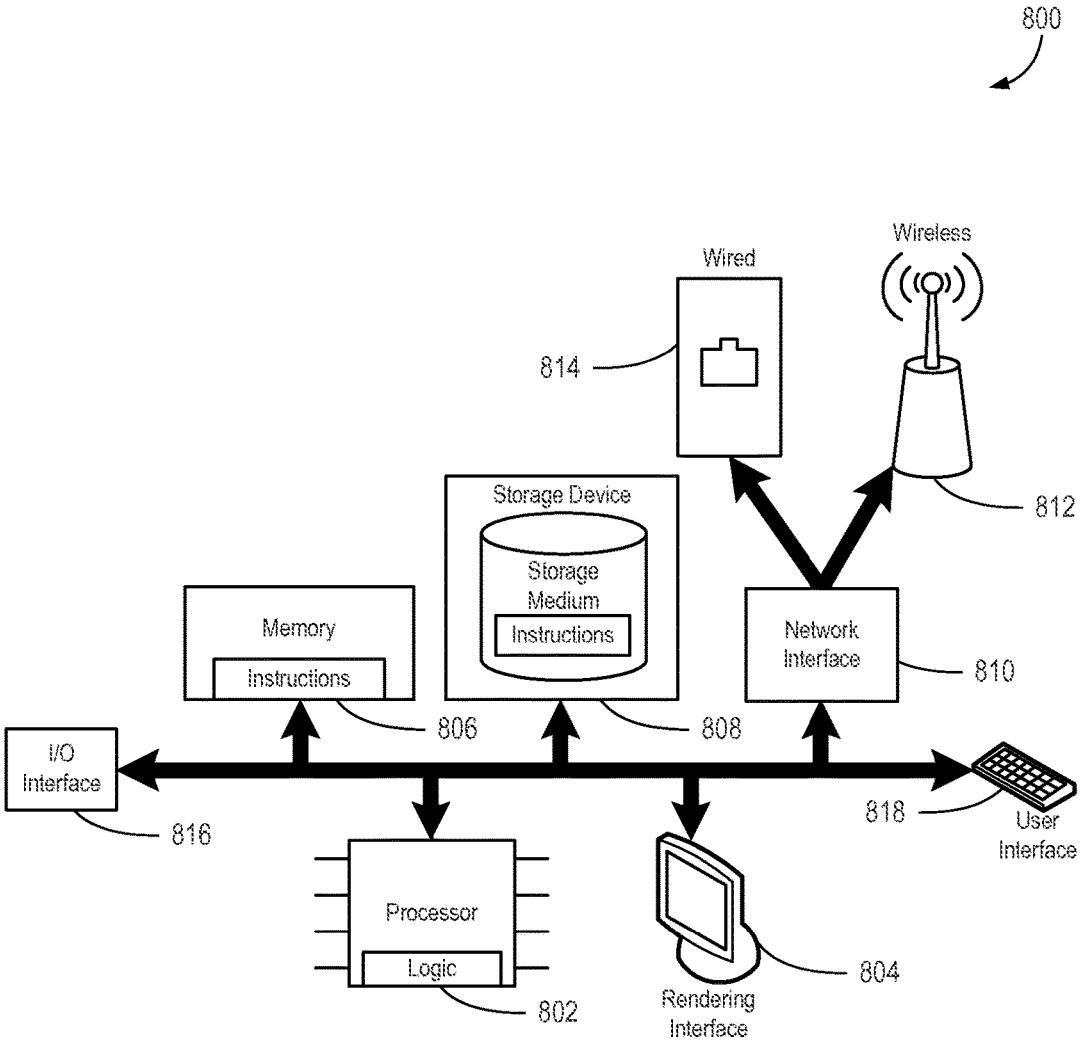
FIG. 8 is a schematic diagram of a computing system.

FIG. 8 is a schematic diagram of a computing system 800 consistent with embodiments disclosed herein. The computing system 800 can be viewed as an information passing bus that connects various components. In the embodiment shown, the computing system 800 includes a processor 802 having logic 802 for processing instructions. Instructions can be stored in and/or retrieved from memory 806 and a storage device 808 that includes a computer-readable storage medium. Instructions and/or data can arrive from a network interface 810 that can include wired 814 or wireless 812 capabilities. Instructions and/or data can also come from an I/O interface 816 that can include such things as expansion cards, secondary buses (e.g., USB), devices, etc. A user can interact with the computing system 800 though user interface devices 818 and a rendering system 804 that allows the computer to receive and provide feedback to the user.

Embodiments and implementations of the systems and methods described herein may include various operations, which may be embodied in machine-executable instructions to be executed by a computer system. A computer system may include one or more general-purpose or special-purpose computers (or other electronic devices). The computer system may include hardware components that include specific logic for performing the operations or may include a combination of hardware, software, and/or firmware.

Computer systems and the computers in a computer system may be connected via a network. Suitable networks for configuration and/or use as described herein include one or more local area networks, wide area networks, metropolitan area networks, and/or Internet or IP networks, such as the World Wide Web, a private Internet, a secure Internet, a value-added network, a virtual private network, an extranet, an intranet, or even stand-alone machines which communicate with other machines by physical transport of media. In particular, a suitable network may be formed from parts or entireties of two or more other networks, including networks using disparate hardware and network communication technologies.

One suitable network includes a server and one or more clients; other suitable networks may contain other combinations of servers, clients, and/or peer-to-peer nodes, and a given computer system may function both as a client and as a server. Each network includes at least two computers or computer systems, such as the server and/or clients. A computer system may include a workstation, laptop computer, disconnectable mobile computer, server, mainframe, cluster, so-called "network computer" or "thin client," tablet, smart phone, personal digital assistant or other hand-held computing device, "smart" consumer electronics device or appliance, medical device, or a combination thereof.

Suitable networks may include communications or networking software, such as the software available from Novell®, Microsoft®, and other vendors, and may operate using TCP/IP, SPX, IPX, and other protocols over twisted pair, coaxial, or optical fiber cables, telephone lines, radio waves, satellites, microwave relays, modulated AC power lines, physical media transfer, and/or other data transmission "wires" known to those of skill in the art. The network may encompass smaller networks and/or be connectable to other networks through a gateway or similar mechanism.

Various techniques, or certain aspects or portions thereof, may take the form of program code (i.e., instructions) embodied in tangible media, such as floppy diskettes, CD-ROMs, hard drives, magnetic or optical cards, solid-state memory devices, a nontransitory computer-readable storage medium, or any other machine-readable storage medium wherein, when the program code is loaded into and executed by a machine, such as a computer, the machine becomes an apparatus for practicing the various techniques. In the case of program code execution on programmable computers, the computing device may include a processor, a storage medium readable by the processor (including volatile and nonvolatile memory and/or storage elements), at least one input device, and at least one output device. The volatile and nonvolatile memory and/or storage elements may be a RAM, an EPROM, a flash drive, an optical drive, a magnetic hard drive, or other medium for storing electronic data. One or more programs that may implement or utilize the various techniques described herein may use an application programming interface (API), reusable controls, and the like. Such programs may be implemented in a high-level procedural or an object-oriented programming language to communicate with a computer system. However, the program(s) may be implemented in assembly or machine language, if desired. In any case, the language may be a compiled or interpreted language, and combined with hardware implementations.

Each computer system includes one or more processors and/or memory; computer systems may also include various input devices and/or output devices. The processor may include a general purpose device, such as an Intel®, AMD®, or other "off-the-shelf" microprocessor. The processor may include a special purpose processing device, such as ASIC, SoC, SiP, FPGA, PAL, PLA, FPLA, PLD, or other customized or programmable device. The memory may include static RAM, dynamic RAM, flash memory, one or more flip-flops, ROM, CD-ROM, DVD, disk, tape, or magnetic, optical, or other computer storage medium. The input device(s) may include a keyboard, mouse, touch screen, light pen, tablet, microphone, sensor, or other hardware with accompanying firmware and/or software. The output device(s) may include a monitor or other display, printer, speech or text synthesizer, switch, signal line, or other hardware with accompanying firmware and/or software.

It should be understood that many of the functional units described in this specification may be implemented as one or more components, which is a term used to more particularly emphasize their implementation independence. For example, a component may be implemented as a hardware circuit comprising custom very large scale integration (VLSI) circuits or gate arrays, or off-the-shelf semiconductors such as logic chips, transistors, or other discrete components. A component may also be implemented in programmable hardware devices such as field programmable gate arrays, programmable array logic, programmable logic devices, or the like.

Components may also be implemented in software for execution by various types of processors. An identified component of executable code may, for instance, comprise one or more physical or logical blocks of computer instructions, which may, for instance, be organized as an object, a procedure, or a function. Nevertheless, the executables of an identified component need not be physically located together, but may comprise disparate instructions stored in different locations that, when joined logically together, comprise the component and achieve the stated purpose for the component.

Indeed, a component of executable code may be a single instruction, or many instructions, and may even be distributed over several different code segments, among different programs, and across several memory devices. Similarly, operational data may be identified and illustrated herein within components, and may be embodied in any suitable form and organized within any suitable type of data structure. The operational data may be collected as a single data set, or may be distributed over different locations including over different storage devices, and may exist, at least partially, merely as electronic signals on a system or network. The components may be passive or active, including agents operable to perform desired functions.

Several aspects of the embodiments described will be illustrated as software modules or components. As used herein, a software module or component may include any type of computer instruction or computer-executable code located within a memory device. A software module may, for instance, include one or more physical or logical blocks of computer instructions, which may be organized as a routine, program, object, component, data structure, etc., that perform one or more tasks or implement particular data types. It is appreciated that a software module may be implemented in hardware and/or firmware instead of or in addition to software. One or more of the functional modules described herein may be separated into sub-modules and/or combined into a single or smaller number of modules.

In certain embodiments, a particular software module may include disparate instructions stored in different locations of a memory device, different memory devices, or different computers, which together implement the described functionality of the module. Indeed, a module may include a single instruction or many instructions, and may be distributed over several different code segments, among different programs, and across several memory devices. Some embodiments may be practiced in a distributed computing environment where tasks are performed by a remote processing device linked through a communications network. In a distributed computing environment, software modules may be located in local and/or remote memory storage devices. In addition, data being tied or rendered together in a database record may be resident in the same memory device, or across several memory devices, and may be linked together in fields of a record in a database across a network.

Reference throughout this specification to "an example" means that a particular feature, structure, or characteristic described in connection with the example is included in at least one embodiment of the present invention. Thus, appearances of the phrase "in an example" in various places throughout this specification are not necessarily all referring to the same embodiment.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on its presentation in a common group without indications to the contrary. In addition, various embodiments and examples of the present invention may be referred to herein along with alternatives for the various components thereof. It is understood that such embodiments, examples, and alternatives are not to be construed as de facto equivalents of one another, but are to be considered as separate and autonomous representations of the present invention.

Furthermore, the described features, structures, or characteristics may be combined in any suitable manner in one or more embodiments. In the above description, numerous specific details are provided, such as examples of materials, frequencies, sizes, lengths, widths, shapes, etc., to provide a thorough understanding of embodiments of the invention. One skilled in the relevant art will recognize, however, that the invention may be practiced without one or more of the specific details, or with other methods, components, materials, etc. In other instances, well-known structures, materials, or operations are not shown or described in detail to avoid obscuring aspects of the invention.

Although the foregoing has been described in some detail for purposes of clarity, it will be apparent that certain changes and modifications may be made without departing from the principles thereof. It should be noted that there are many alternative ways of implementing both the processes and apparatuses described herein. Accordingly, the present embodiments are to be considered illustrative and not restrictive, and the invention is not to be limited to the details given herein, but may be modified within the scope and equivalents of the appended claims.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. An antenna system comprising:

a feed network comprising a feed input port configured to provide a reference wave;

an aperture coupled to the feed network and approximated by an aperture taper function, the aperture comprising a set of radiating aperture elements having an element modulation range and configured to selectively transfer energy from the reference wave, the set of radiating aperture elements configured to radiate a beam pattern based on energy received from the reference wave; and a processor configured to:

select an antenna-plane pattern;

determine an ideal holographic modulation pattern from the reference wave and the antenna-plane pattern;

multiply the aperture taper function with the ideal holographic modulation pattern;

discard a phase portion of the ideal holographic modulation pattern and retain a magnitude of the ideal holographic modulation pattern to form a real modulation pattern;

shift and scale the elements of the real modulation pattern to lie within the upper and lower bounds of the element modulation range to form an aperture modulation pattern; and apply the aperture modulation pattern created using the magnitude of the ideal holographic modulation pattern by discarding the phase portion of the ideal holographic modulation pattern to the aperture to approximate the selected antenna-plane pattern in the beam pattern radiated by the aperture using the energy received from the reference wave.

2. The system of claim 1, wherein the reference wave is propagating through a transmission line structure.

3. The system of claim 1, wherein the reference wave further comprises a set of fields in the feed network.

4. The system of claim 1, wherein the antenna system further comprises metamaterial surface antenna technology (MSA-T).

5. The system of claim 4, wherein the set of radiating aperture elements further comprises metamaterial elements.

6. The system of claim 4, wherein the set of radiating aperture elements comprises sub-wavelength antenna elements, each configured to emit an electromagnetic emission in response to received electromagnetic energy, wherein each of the sub-wavelength antenna elements comprises at least one electromagnetically resonant element, and wherein a physical diameter of individual sub-wavelength antenna elements is less than an effective wavelength of the electromagnetic emission.

7. The system of claim 1, wherein to apply the aperture modulation pattern to the aperture further comprises to modulate an impedance of the aperture in electromagnetic contact with the reference wave.

8. The system of claim 1, wherein the aperture modulation pattern causes a sampled approximation of the selected antenna-plane pattern.

9. The system of claim 1, wherein to select the antenna-plane pattern further comprises:

define a two-dimensional far-field beam pattern; and back-propagate the two-dimensional far-field beam pattern to an antenna plane.

10. A system for beam shaping, the system comprising:

storage configured for storing an aperture taper function and an element modulation range of an aperture; and a processor configured to:

determine an ideal modulation pattern based at least in part on a reference wave from a feed network of an antenna multiplied by an antenna-plane pattern;

multiply the aperture taper function with the ideal modulation pattern;

retain a magnitude portion of the ideal modulation pattern to form a real modulation pattern;

form an aperture modulation pattern by shifting or scaling the real modulation pattern to fit within a lower bound of the element modulation range of the aperture and an upper bound of the element modulation range of the aperture; and determine an aperture plane pattern of the aperture based at least in part on a product of the aperture modulation pattern created using the magnitude portion of the ideal holographic modulation pattern and the reference wave, the aperture plane pattern used to configure the aperture to radiate a beam pattern according to the antenna-plane pattern using energy received from the reference wave.

11. The device of claim 10, wherein the processor is further configured to apply the aperture plane pattern of the aperture to an antenna system aperture.

12. The device of claim 11, wherein to apply the aperture plane pattern to the antenna system aperture further comprises to modulate an impedance of the antenna system aperture in electromagnetic contact with the reference wave.

13. The device of claim 11, further comprising an antenna system that includes the aperture.

14. The device of claim 13, wherein the antenna system further comprises:

a set of radiating elements coupled to the aperture, wherein the aperture further comprises a set of aperture elements, and wherein each aperture element corresponds to a radiating element.

15. The device of claim 10, wherein the processor is further configured to select the antenna-plane pattern.

16. The device of claim 15, wherein to select the antenna-plane pattern further comprises to receive the antenna-plane pattern from an external system.

17. The device of claim 15, wherein to select the antenna-plane pattern further comprises:

define a two-dimensional far-field beam pattern; and back-propagate the two-dimensional far-field beam pattern to an antenna plane.

18. The device of claim 15, wherein to select the antenna-plane pattern further comprises to determine the antenna-plane pattern based on a selected projected beam pattern.

19. The device of claim 18, wherein the processor is further configured to cause a set of radiating elements coupled to the aperture to emit a beam pattern based on the selected projected beam pattern.

20. The device of claim 10, wherein the reference wave is propagating through a transmission line comprising a parallel-plate waveguide, a rectangular waveguide or a microstrip line.

21. The device of claim 10, wherein the processor is configured to control an antenna system comprising a set of radiating elements coupled to the aperture.

22. The device of claim 21, wherein the set of radiating elements further comprises metamaterial elements.

23. The device of claim 21, wherein the set of radiating elements comprises sub-wavelength antenna elements, each configured to emit an electromagnetic emission in response to received electromagnetic energy, wherein each of the sub-wavelength antenna elements comprises at least one electromagnetically resonant element, and wherein a physical diameter of individual sub-wavelength antenna elements is less than an effective wavelength of the electromagnetic emission.

* * * * *